United States Patent [19]

Johnson

[11] Patent Number: 4,834,274

[45] Date of Patent: May 30, 1989

[54] APPARATUS FOR CARRYING A CASSETTE TAPE PLAYER AND A PLURALITY OF CASSETTE TAPES ON THE BODY OF A PERSON

[76] Inventor: Barry E. Johnson, 845 E. 57th St., Brooklyn, N.Y. 11234

[21] Appl. No.: 109,582

[22] Filed: Oct. 19, 1987

[51] Int. Cl.[4] ..... A45F 5/00; B65D 25/10

[52] U.S. Cl. ..... 224/240; 224/242; 224/249

[58] Field of Search ..... 224/252, 253, 242, 245, 224/247, 240, 224, 904, 226, 249, 269

[56] References Cited

U.S. PATENT DOCUMENTS

| | | | |
|---|---|---|---|
| 1,214,161 | 1/1917 | Hettinger et al. | 224/252 X |
| 3,297,217 | 1/1967 | Nichols | 224/240 |
| 3,586,977 | 6/1971 | Lustig et al. | 224/252 X |
| 4,046,295 | 9/1977 | Eichler | 224/242 |
| 4,408,706 | 10/1983 | Hurley | 224/904 X |
| 4,412,106 | 10/1983 | Pavel | 224/253 X |
| 4,420,078 | 12/1983 | Belt et al. | 224/236 X |
| 4,479,596 | 10/1984 | Swanson | 224/236 |
| 4,569,465 | 2/1986 | O'Farrell | 224/224 |
| 4,620,653 | 11/1986 | Farrell | 224/242 |
| 4,676,419 | 6/1987 | Victor | 224/252 |
| 4,722,464 | 2/1988 | Wright | 224/224 |

*Primary Examiner*—Werner H. Schroeder

*Attorney, Agent, or Firm*—Klauber & Jackson

[57] ABSTRACT

Apparatus for carrying a cassette tape player and a plurality of cassette tapes on the body of a person includes a belt which is secured about the body of the person; a tape player holder which holds a cassette tape player; three male snap elements in a triangular configuration mounted on the belt and three female snap elements mounted on the tape player holder for engagement with the male snap elements to secure the tape player holder on the belt at the left or right hip area; a plurality of cassette tape holders, each adapted to hold a cassette tape; a plurality of pairs of vertically spaced male snap elements mounted on the belt and two vertically spaced female snap elements mounted on each cassette tape holder for engagement with selected ones of the male snap elements to releasably secure each cassette tape holder at a selected one of a plurality of different positions on the belt. The tape player holder can take one of three different forms.

7 Claims, 11 Drawing Sheets

APPARATUS FOR CARRYING A CASSETTE TAPE PLAYER AND A PLURALITY OF CASSETTE TAPES ON THE BODY OF A PERSON

BACKGROUND OF THE INVENTION

This invention relates generally to cassette tape playing apparatus and, more particularly, is directed to apparatus for carrying a cassette tape player and a plurality of cassette tapes on the body of a person.

Growth in the use of portable cassette tape players, such as those of the type sold by Sony Corporation under the trademark "Walkman," has increased tremendously over the last ten years. Such Walkman-type cassette tape players are commonly used, for example, when a person is engaging in active sports, such as jogging or bicycling, while a person is walking, and during travel to and from different places, among other uses. However, during these uses, such Walkman-type portable cassette tape player is generally carried in the person's hand, since it is generally too large to place in a pocket. In some cases, the tape players are placed in knapsacks, briefcases or the like carried by the person. However, the electrical line from the cassette tape player to the headphones therefore extends a large distance and becomes obtrusive.

In some instances, containers, pouches or the like are provided for holding the cassette tape players and include a slot through which an existing belt can be looped so as to hold the cassette tape players on the belt of a person. These containers, however, are specific to the particular cassette tape player, and cannot generally be interchangeably used with other cassette tape players. In this regard, reference is also made to U.S. Pat. No. 4,620,653 which shows a pocket that can be used to hold a cassette tape player and is adjustably secured to a belt at a specific location. A problem with this pocket, however, is that the control knobs and the like at the sides of the cassette tape player are not easily accessible.

Further, a plurality of cassettes tapes are also usually carried with such cassette tape player. In such instance, a separate carry bag must generally be provided for carrying the cassette tapes. This, however, becomes inconvenient, particularly when jogging or bicycling, and retrieval of a desired cassette tape also becomes onerous.

Other devices which may be of relevance to the present invention are disclosed in U.S. Pat. Nos. 4,046,295; 4,073,416; 4,299,344; 4,500,019; and 4,545,414.

OBJECTS AND SUMMARY OF THE INVENTION

Accordingly, it is an object of the present invention to provide apparatus for carrying a cassette tape player and a plurality of cassette tapes on the body of a person, that overcomes the aforementioned disadvantages.

It is another object of the present invention to provide apparatus for carrying a cassette tape player and a plurality of cassette tapes on the body of a person, in which a cassette tape player holder and a plurality of cassette tape holders are carried on a belt secured on the body of the person.

It is still another object of the present invention to provide apparatus for carrying a cassette tape player and a plurality of cassette tapes on the body of a person, in which the number and location of the cassette tape holders on the belt can be selectively varied.

It is yet another object of the present invention to provide apparatus for carrying a cassette tape player and a plurality of tapes on the body of a person, in which the cassette tape player holder can be selectively positioned at different locations on the belt.

It is a further object of the present invention to provide a cassette tape player holder for use of such apparatus that securely holds any of a plurality of different cassette tape players, while also permitting access to control knobs and the like on the sides and top thereof.

It is a still further object of the present invention to provide a belt for use with the aforementioned apparatus that can extend across the waist of the chest of the person for supporting a cassette tape player holder and plurality of cassette tape holders thereon.

In accordance with one aspect of the present invention, apparatus for carrying a cassette tape player and at least one cassette tape on a body of a person, includes belt means for securement about the body of the person; tape player holder means for holding a cassette tape player; first securing means for releasably securing the tape player holder means on the belt means; at least one cassette holder means for holding at least one cassette tape; and second securing means for releasably securing each cassette tape holder means at a selected one of a plurality of different positions on the belt means.

In accordance with another aspect of the present invention, a holder for a cassette tape player includes a substantially rectangular box having a front opening through which the cassette tape player can be positioned in the box; cover means pivotally connected to the box adjacent the front opening for movement between a first position in covering relation to the front opening and a second position permitting access within the box through the front opening; latch means secured to the cover means for releasably latching the cover means in the first position; release means secured to the box for releasing the latch means from the cover means; and securing means for releasably securing the box onto wearing apparel secured on the body of a person.

In accordance with still another aspect of the present invention, a holder for a cassette tape player includes a rear panel; bottom panel means connected with the rear panel for supporting the cassette tape player; gripping means secured to the rear panel for retaining the cassette tape player on the bottom panel means; and securing means for releasably securing the rear panel onto wearing apparel secured on the body of a person.

In accordance with yet another aspect of the present invention, a holder for a cassette tape player includes bottom leg means for supporting the cassette tape player; rear leg means secured to the bottom leg means for restraining the cassette tape player; restraining leg means telescopically movable with respect to at least one of the bottom leg means and rear leg means; the restraining leg means including a free end having gripping means for gripping the cassette tape player; biasing means for biasing the restraining leg means toward the at least one of the bottom leg means and rear leg means so that the gripping means of the restraining leg means grips the cassette tape player; and securing means for releasably securing the at least one of the bottom leg means and the rear leg means onto wearing apparel secured on the body of a person.

The above and other objects, features and advantages of the present invention will become readily apparent from the following detailed description thereof which is to be read in connection with the accompanying drawings.

DETAILED DESCRIPTION OF THE PREFERRED EMBODIMENTS

Figure 1:
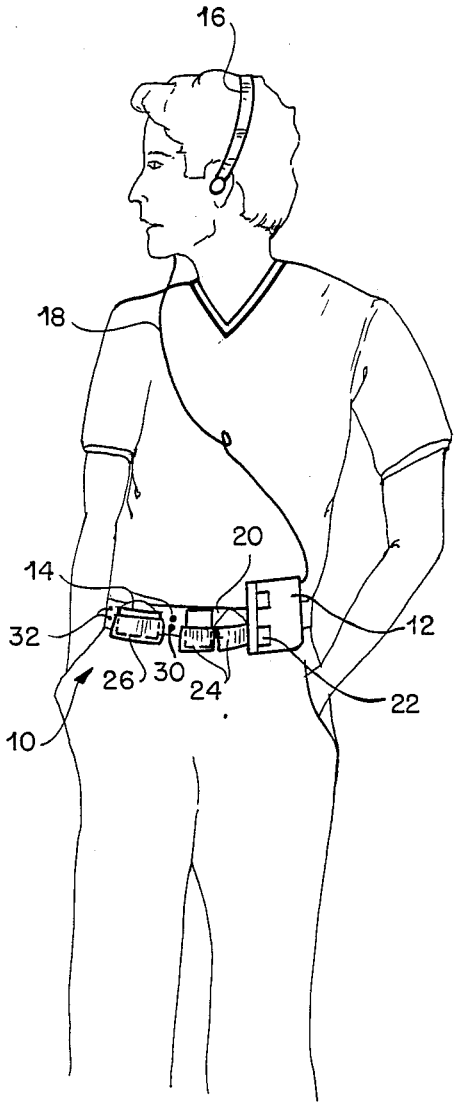
FIG. 1 is a perspective view of apparatus for carrying a cassette tape player and a plurality of cassette tapes according to a first embodiment of the present invention and illustrated being worn on the body of a person;.
Figure 2:
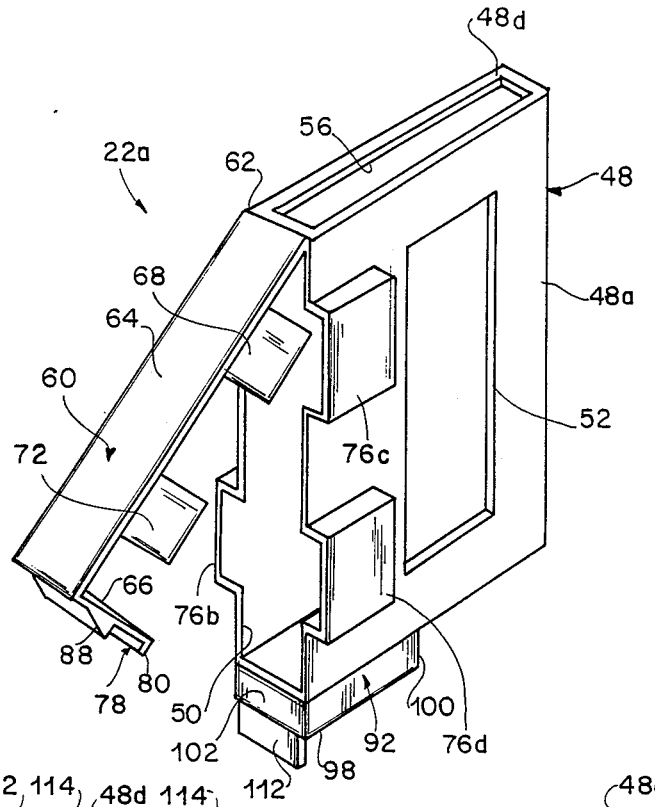
FIG. 2 is a perspective view of a cassette tape player holder according to a first embodiment of the present invention.
Figure 3:
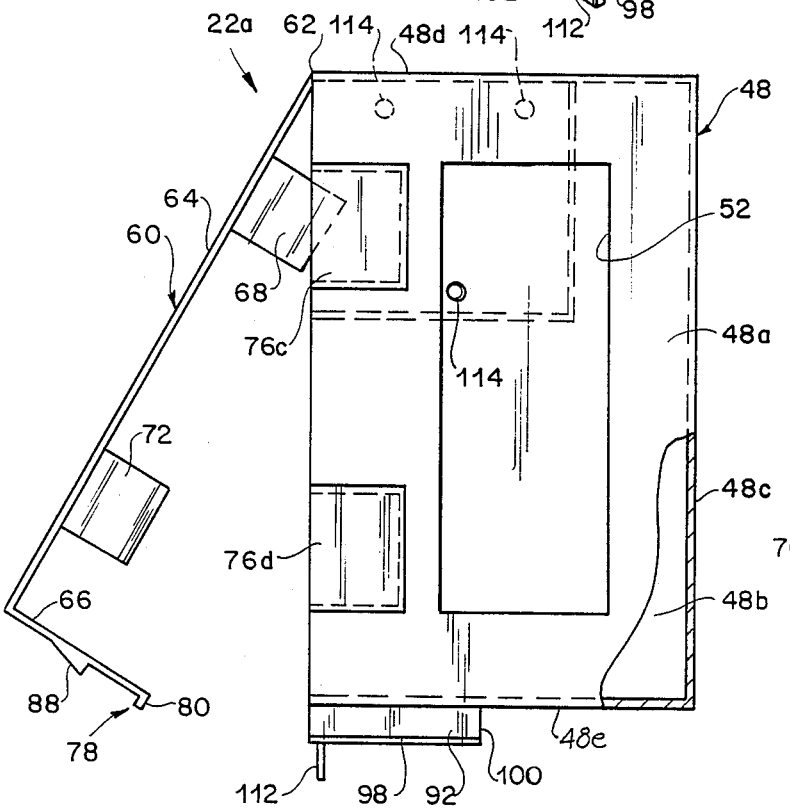
FIG. 3 is a side elevational view of the cassette tape player holder of FIG. 2.
Figure 4:
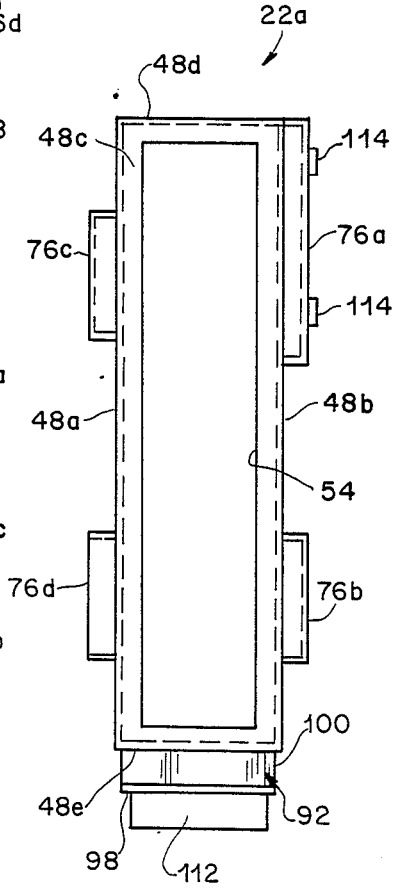
FIG. 4 is a rear elevational view of the cassette tape player holder of FIG. 2.
Figure 5:
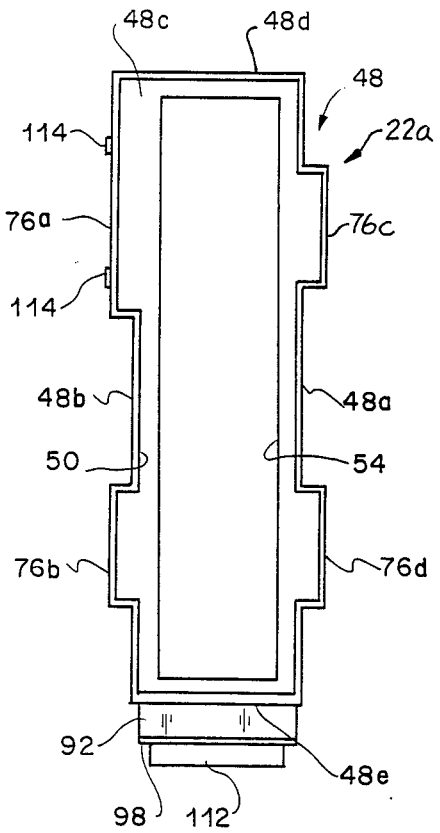
FIG. 5 is a front elevational view of the cassette tape player holder of FIG. 2.
Figure 6:
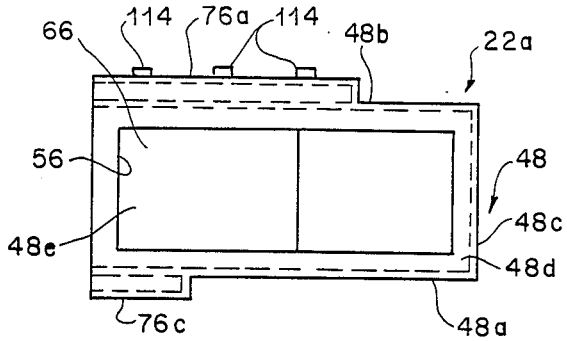
FIG. 6 is a top plan view of the cassette tape player holder of FIG. 2.
Figure 7:
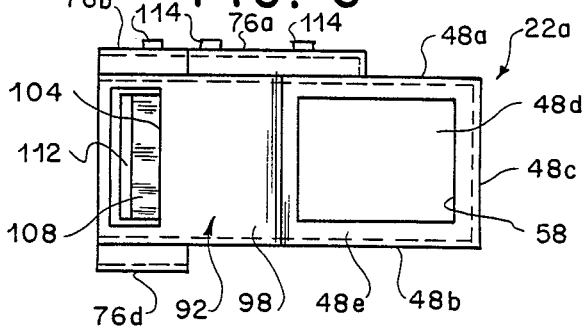
FIG. 7 is a bottom plan view of the cassette tape player holder of FIG. 2.
Figure 8:
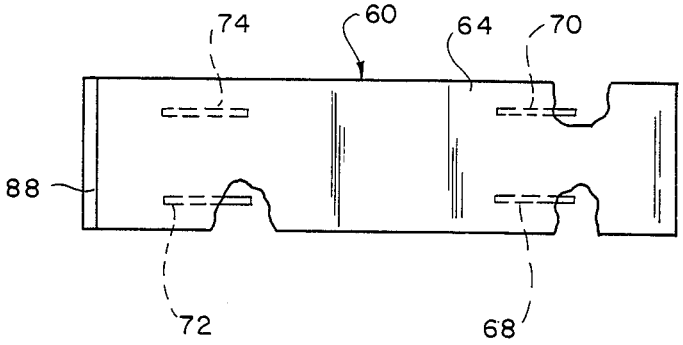
FIG. 8 is a front plan view of the hinged cover of the cassette tape player holder of FIG. 2, partially broken away.

Referring to the drawings in detail, and initially to FIG. 1 thereof, apparatus 10 according to a first embodiment of the present invention is provided for carrying a cassette tape player 12, of the general type sold by Sony Corporation under the trademark "Walkman", and a plurality of cassette tapes 14 for use with cassette tape player 12. Cassette tape player 12 also includes a set of headphones 16 and electrical wire 18 connecting headphones 16 to cassette tape player 12, as is conventional.

In accordance with a first embodiment of the present invention, a belt 20 is secured about the waist of a person. A cassette tape player holder 22 is removably secured to belt 20 and holds cassette tape player 12 safely therein. In addition, two different types of cassette tape holders 24 and 26 can also be removably secured to belt 20, each for holding a cassette tape therein.

Figure 23:
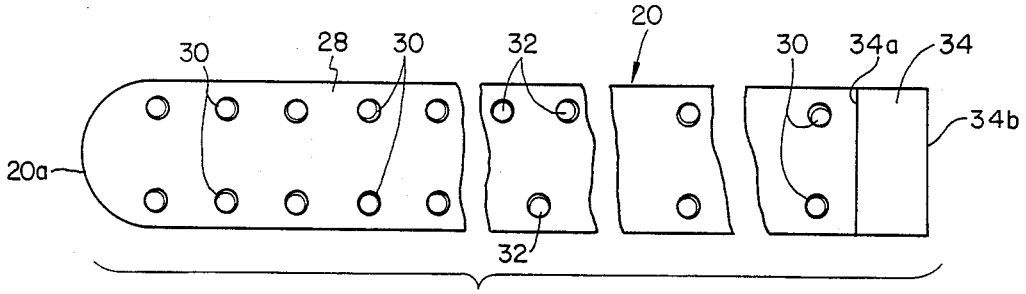
FIG. 23 is a plan view of the belt of the apparatus of FIG. 1.
Figure 24:
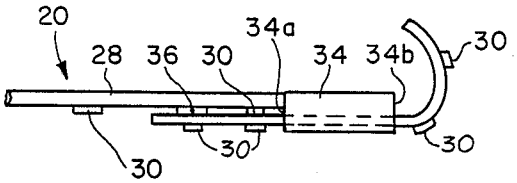
FIG. 24 is a top plan view of a portion of the belt of FIG. 23 and the securing assembly for securing the belt about the waist of a person.

Specifically, belt 20 is shown in FIGS. 23 and 24 as including an elongated belt material 28, such as belt webbing, leather or the like. Pairs of vertically spaced male snap elements 30 are spaced from each other in the lengthwise or horizontal direction of belt material 28, each pair of male snap elements 30 being adapted to releasably secure a cassette tape holder 24 or 26 thereon, as will be explained in greater detail below. In this manner, the number and position of the cassette tape holders secured onto belt 20 can be varied.

In addition, two sets of three male snap elements 32 arranged in a triangular configuration are arranged on belt 20, each set being positioned diametrically opposite each other when belt 20 is positioned about the waist of a person. Specifically, when belt 20 is positioned on the waist of a person, snap elements 32 are positioned at the left and right hip areas of the person, and are provided for releasably securing cassette tape player holder 22 at the left or right hip of the person.

Belt 20 can be secured about the waist of a person by any conventional means. As an example, one end of belt 20 can be provided with a hollow rectangular housing 34 which is open at opposite ends **34*a* and 34*b* thereof, and through which the opposite end 20*a* of belt 20 can extend. Such opposite end 20*a* of belt 20 includes two vertically separated female snap elements 36 which engage with any pair of male snap elements 30 after extending through housing 34 so as to secure belt 20** about the waist of a person. In this manner, male snap elements 30 perform a two-fold function, namely, to provide adjustability of the belt about the waist of a person and to secure cassette tape holders 24 and 26 thereon. Of course, any outer suitable means of securing belt 20 about the waist of a person can be used in accordance with the present invention.

Figure 25:
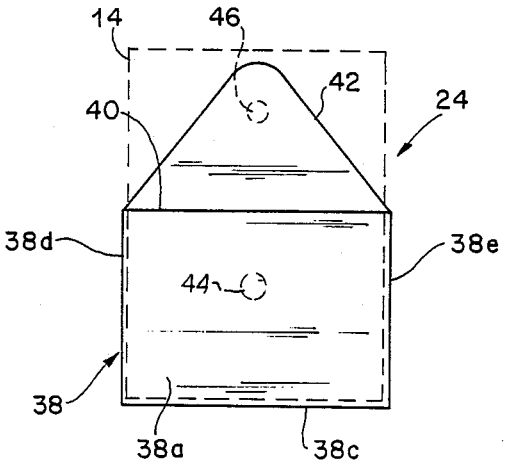
FIG. 25 is a front plan view of a cassette tape holder according to one embodiment of the present invention.
Figure 26:
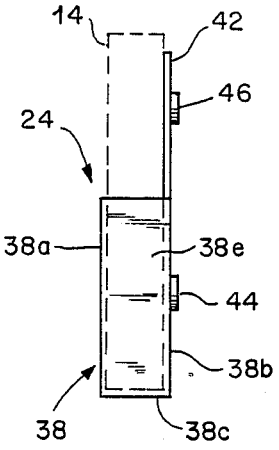
FIG. 26 is a side elevational view of the cassette tape holder of FIG. 25.

Cassette tape holder 24 is shown more particularly in FIGS. 25 and 26. Specifically, cassette tape holder 24 includes a rectangular housing 38 which is open at its upper end 40. Housing 38 includes a front wall 38*a*, rear wall 38*b*, bottom wall 38*c* and side walls 38*d* and 38*e*. A flap 42 extends upwardly from rear wall 38*b* of housing 38. Although flap 42 preferably has a triangular configuration, as shown, it is not limited to such configuration. The rear surface of rear wall 38*b* includes a female snap element 44 and the rear surface of flap 42 includes a female snap element 46 vertically aligned with female snap element 44 and separated therefrom by the same distance as the snap elements 30 of each pair on belt 20. In this manner, cassette tape holder 24 can be snapped onto belt 20 at any desired location, that is, at any location where there is a pair of male snap elements 30, as shown in FIG. 1. In the embodiment of cassette tape holder 24, it will be appreciated that cassette tape 14, which has a rectangular configuration, is situated vertically in cassette tape holder 24, that is, with its longer sides extending in the vertical direction when cassette tape holder 24 is snapped onto belt 20.

Figure 27:
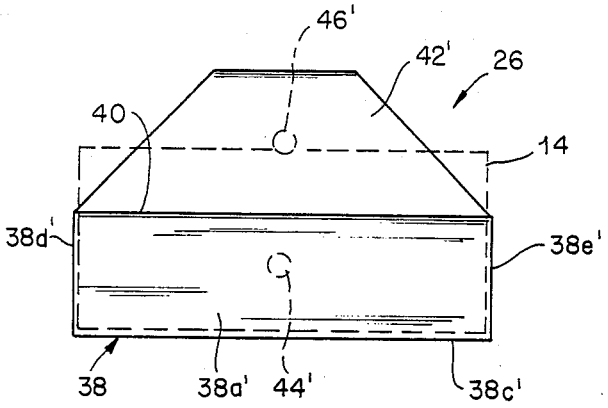
FIG. 27 is a front plan view of a cassette tape holder according to another embodiment of the present invention.
Figure 28:
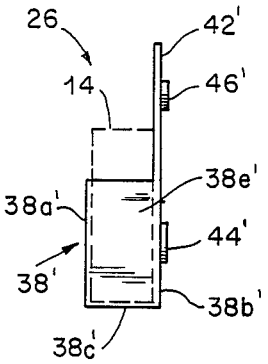
FIG. 28 is a side elevational view of the cassette tape holder of FIG. 27.

Alternatively, as shown in FIGS. 27 and 28, cassette tape holder 26 can be used in place of cassette tape holder 24. Elements similar to those described above with respect to cassette tape holder 24 of FIGS. 25 and 26 are identified by the same reference numerals in FIGS. 27 and 28, with a prime added to the numeral. Basically, cassette tape holder 26 differs from cassette tape holder 24 by the provision that housing 38′ is wider in the horizontal direction and shorter in the vertical direction so that cassette tape 14 is positioned within housing 38*c*′ in a manner turned substantially 90 degrees from the arrangement in cassette holder 24. In addition, flap 42′ is formed in a truncated triangular shape. As with cassette tape holder 24, female snap elements 44′ and 46′ of cassette tape holder 26 can be selectively snapped onto any pair of male snap elements 30 on belt 20.

Referring now to FIGS. 2–12, a cassette tape player holder 22*a* according to one embodiment of the present invention generally includes a substantially rectangular housing 48 formed by side walls 48*a* and 48*b*, rear wall 48*c*, a top wall 48*d* and a bottom wall 48*e*. It will be appreciated from FIG. 2 that no front wall is provided, that is, rectangular housing 48 includes a front opening 50 through which a cassette tape player 12 fits. In addition, to provide access to the various controls on cassette tape player 12 when positioned in rectangular housing 48, and to save material costs, side wall 48*a* is provided with a rectangular opening 52, rear wall 48*c* is provided with a rectangular opening 54, top wall 48*d* is provided with a rectangular opening 56 and bottom wall 48*e* is provided with a rectangular opening 58 at the rear half thereof.

A cover 60 is pivotally secured, for example, by a living hinge 62 to top wall 48*d* at front opening 50. In this manner, cover 60 is dimensioned so as to substantially cover front opening 50 when moved to its closed position. Cover 60 includes a rigid, substantially rectangular flat panel 64 which is pivotally secured to top wall 48*d* by living hinge 62. A bottom panel 66 is secured substantially perpendicular to panel 64 at the free end thereof and extends inwardly toward rectangular housing 48. In addition, a first pair of clip elements 68 and 70 are provided in parallel, spaced apart relation at the inside surface of flat panel 64 near the upper end thereof and a second pair of similarly arranged clip elements 72 and 74 are provided at the lower end at the inside surface of flat panel 64. Clip elements 68–74 are adapted to grasp cassette tape player 12 therebetween while the latter rests on bottom panel 66. In this manner, cassette tape player 12 is releasably held by cover 60. In this regard, clip elements 68–74 can be made of a suitable material, such as a thin piece of metal having spring-like qualities. Thus, when cassette tape player 12 is positioned therebetween, clip elements 68–74 are biased outwardly and provide a spring-like gripping force on cassette tape player 12.

Because of the outward expansion of clip elements 68–74, side walls 48*a* and 48*b* of rectangular housing 48 are provided with housing pocket portions 76*a*–76*d* which effectively expand the width of front opening 50 thereat so as to receive clip elements 68–74 when the latter have been expanded and thereby to prevent obstruction by the walls surrounding front opening 50, when closing cover 60.

Thus, with cassette tape player holder 22*a* as thus described, cover 60 is pivoted to its fully opened position, that is, substantially parallel with top wall 48*d* and cassette tape player 12 is positioned between clips 68–74 so that it rests against bottom panel 66. Then, cover 60 is pivoted about living hinge 62 to its closed position in covering relation to front opening 50, whereby cassette tape player 12, which is held by cover 60, is positioned safely within rectangular housing 48.

In order to prevent cover 60 from being accidentally opened and to thus releasably latch cover 60 to rectangular housing 48, bottom panel 66 is provided with a latch mechanism 78 formed by a downwardly turned flange 80 at the free end of bottom panel 66. Bottom wall 48*e* of housing 48 is provided with another opening 82 so as to define a catch edge 84. Accordingly, when cover 60 is pivoted to its closed position so that bottom panel 66 is moved into the interior of rectangular housing 48, flange 80 rides over and engages catch edge 48 to prevent accidental opening of cover 60, as shown best in FIG. 9.

In order to release flange 80 from catch edge 84, a release mechanism 86 is provided. Specifically, release mechanism 86 includes an inclined ramp 88 at the lower surface of bottom panel 66. Bottom wall 48*e* of rectangular housing 48 includes another opening 90 spaced forwardly of opening 82 for receiving ramp 88 when cover 60 is moved to its closed position, whereby ramp 88 extends below bottom wall 48*e*.

Figure 9:
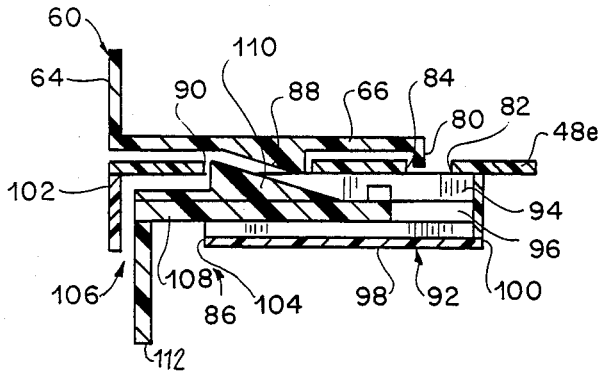
FIG. 9 is a cross-sectional view of the latch and release means of the cassette tape player holder of FIG. 2.
Figure 10:
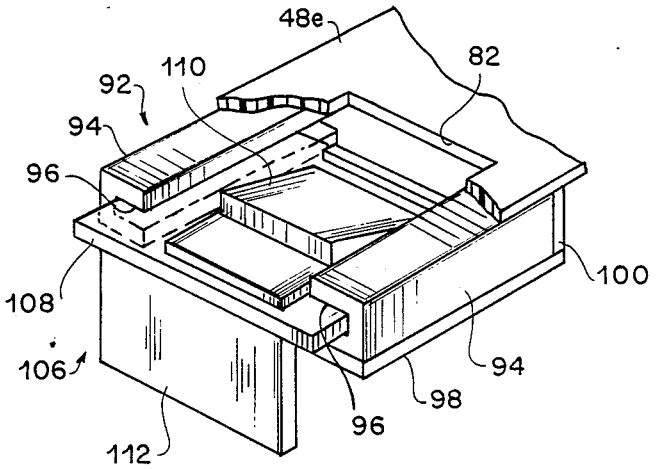
FIG. 10 is a perspective view of a portion of the release means of FIG. 9.
Figure 11:
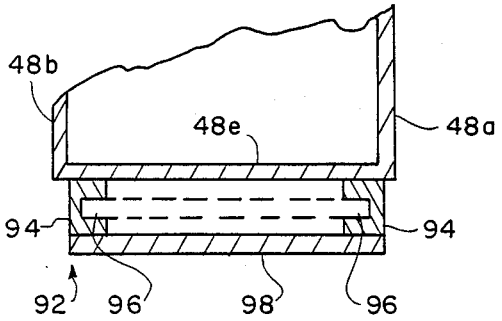
FIG. 11 is a cross-sectional view of a portion of the cassette tape player holder of FIG. 2, which is used to hold the release means.
Figure 12:
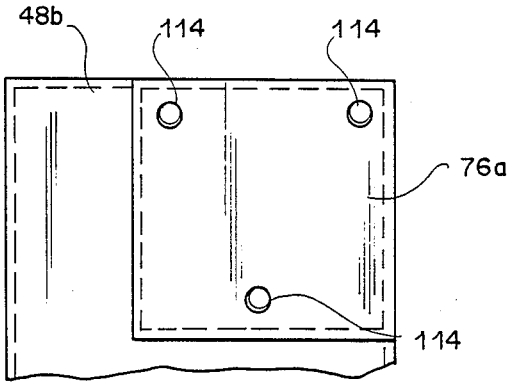
FIG. 12 is a side elevational view of the securing snap arrangement for securing the cassette tape player holder of FIG. 2 to a belt.
Figure 13:
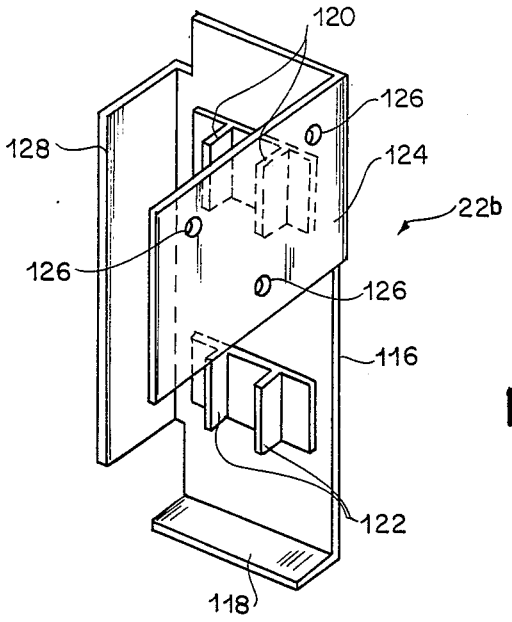
FIG. 13 is a perspective view of a cassette tape player holder according to another embodiment of the present invention.
Figure 14:
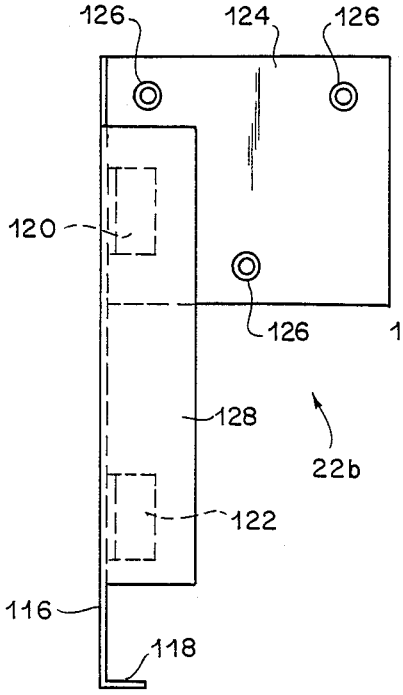
FIG. 14 is a left side elevational view of the cassette tape player holder of FIG. 13.
Figure 15:
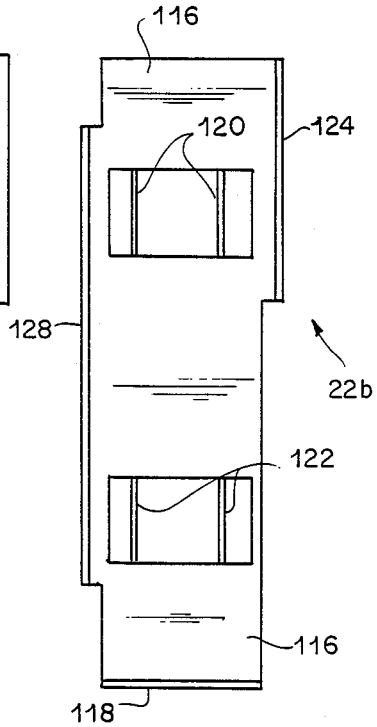
FIG. 15 is a front elevational view of the cassette tape player holder of FIG. 13.
Figure 16:
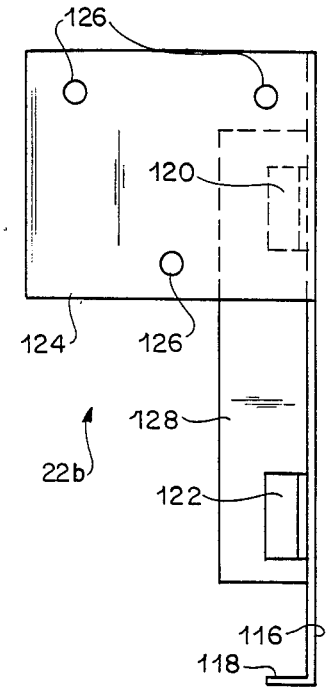
FIG. 16 is a right side elevational view of the cassette tape player holder of FIG. 13.
Figure 17:
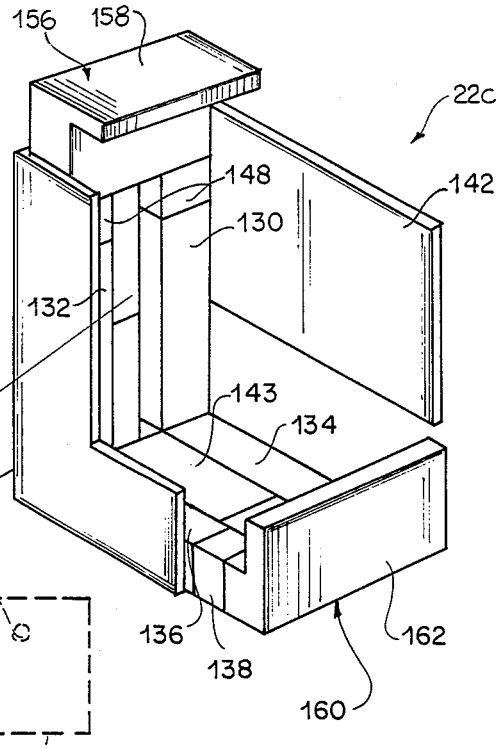
FIG. 17 is a perspective view of a cassette tape player holder according to still another embodiment of the present invention.
Figure 18:
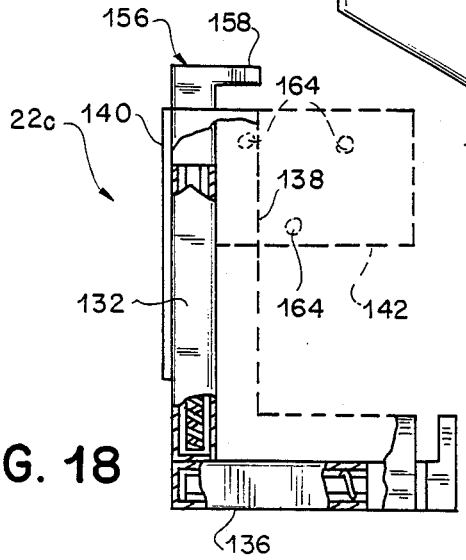
FIG. 18 is a partially broken away, side elevational view of the cassette tape player holder of FIG. 17.

Release mechanism 86 also includes a lower housing 92 secured to bottom wall 48*e* at the front half of housing 48. Specifically, lower housing 92 includes two elongated U-shaped guideways 94 spaced apart from each other at opposite sides of rectangular housing 48, each defining a trackway 96, with trackways 96 facing each other. Each guideway 94 is secured to bottom wall 48*e* by any suitable means. A bottom plate 98 is secured to the bottom legs of guideways 94 and a rear plate 100 is secured to the rear ends of guideways 94. In addition, lower housing 92 includes a front plate 102. An opening 104, best shown in FIG. 9, is provided in bottom plate 98. Accordingly, lower housing 92 is only open at opening 104 and at openings 82 and 90 provided in bottom wall 48e.

Release mechanism 86 further includes a release member 106 slidable within lower housing 92 for disengaging flange 80 from catch edge 84 so that cover 60 can be pivoted to its open position. In this regard, release member 106 includes a flat slide plate 108 which is slidably received within trackways 96 so as to slide in the lengthwise direction within lower housing 92. A ramp surface 110 is provided on the upper surface of slide plate 108 so that, as slide plate 108 slides to the right in FIG. 9, ramp surface 110, which extends through opening 90 in bottom wall 48e, abuts and upwardly ramps or biases bottom panel 66 of cover 60 so as to release flange 80 from catch edge 84. Then, cover 60 can be pivoted about living hinge 62 so as to move cover 60 to its open position.

In order to actuate release member 106, the latter includes a slide lever 112 which extends from the front edge of slide plate 108 downwardly through opening 104. Accordingly, the user can release cover 60 by merely pushing slide lever 112 toward the right in FIG. 9. In this manner, cover 60 can be releasably locked in position to prevent accidental escape thereof and possible damage to cassette tape player 12.

In order to secure cassette tape player holder 22a to belt 20, housing pocket portion 76a is formed larger than housing pocket portions 76b–76d, and three female snap elements 114 are secured to side wall 48b at housing pocket portion 76a of rectangular housing 48 in a triangular configuration which is identical to the triangular configuration of male snap elements 32 on belt 20. Accordingly, female snap elements 114 can mate with male snap elements 30 on either side of belt 20 so as to removably secure the same on belt 20 at the left or right hip of the user, as shown in FIG. 1.

Referring now to FIGS. 13–16, a cassette tape player holder 22b according to another embodiment of the present invention includes a flat rear panel 116 having a slightly inturned bottom flange 118 secured to the lower edge thereof 116 and thereby forming a bottom wall for supporting cassette tape player 12 thereon.

A first upper pair of parallel clip elements 120 are secured to the inner surface of rear panel 116 and a lower pair of parallel clip elements 122 are secured in parallel relation to the inside surface of rear panel 116 in vertical alignment with clip elements 120. Accordingly, cassette tape player 12 can be positioned between clip elements 120 and 122 and supported on bottom flange 118. In order to secure cassette tape player holder 22b to belt 20, a securing plate 124 is connected at an upper, side edge of rear panel 116 and extends substantially perpendicular thereto in the same direction as bottom flange 118. Three female snap elements 126 are connected to securing plate 124 in a triangular configuration which is identical to the triangular configuration of male snap elements 32 so that female snap elements 126 can engage male snap elements 32 to removably secure cassette tape player holder 22b to belt 20. In addition, a protective plate 128 is secured to the opposite side edge of rear panel 116, substantially parallel to securing plate 124, and is provided to prevent escape of cassette tape player 12 thereat and also to prevent harmful elements from damaging cassette tape player 12. It will be appreciate that, with this embodiment, access to the controls of cassette player 12 is readily provided.

Referring now to FIGS. 17–22, a cassette tape player holder 22c according to a third embodiment of the present invention, includes first and second vertical legs 130 and 132 in parallel spaced relation from each other and connected at the lower ends thereof to first and second horizontal legs 134 and 136, respectively, and at substantially right angles thereto. Legs 130–136 are hollow and are open at their free ends. In order to further secure legs 130–136 together, an L-shaped front protective plate 138 is secured to second vertical leg 132 and second horizontal leg 136. In addition, a securing plate 140 is connected to the rear surfaces of first and second vertical legs 130 and 132 and wraps around the opposite side of cassette tape player holder 22c so as to be spaced from and substantially parallel to front protective plate 138 at a support section 142 thereof. Further, a bridging plate 143 can connect legs 134 and 136, and thereby provide a continuous flat, horizontal surface, along with the upper surfaces of legs 134 and 136, to support a cassette tape player 12 thereon.

Figure 19:
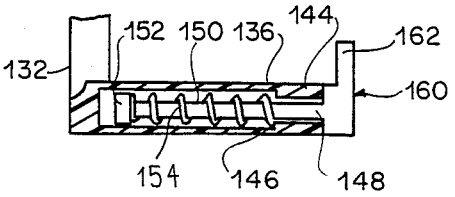
FIG. 19 is a cross-sectional view of a portion of one of the legs of the cassette tape holder of FIG. 17.
Figure 20:
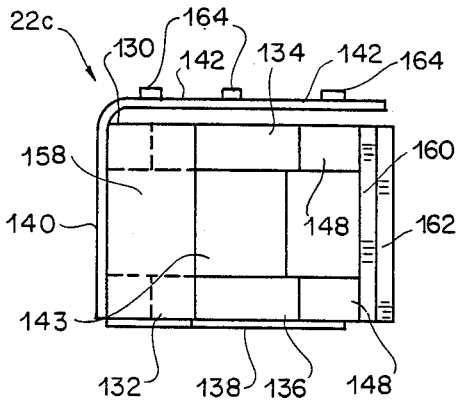
FIG. 20 is a top plan view of the cassette tape player holder of FIG. 17.
Figure 21:
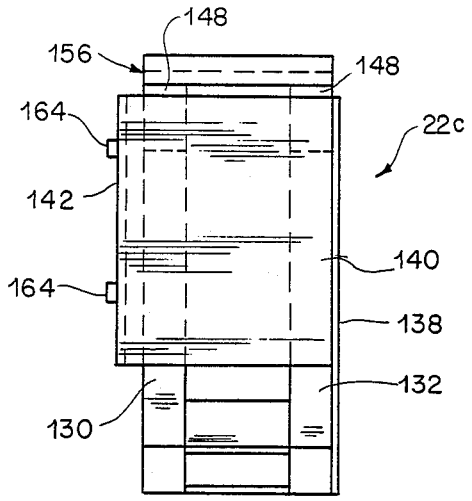
FIG. 21 is a rear elevational view of the cassette tape player holder of FIG. 17.
Figure 22:
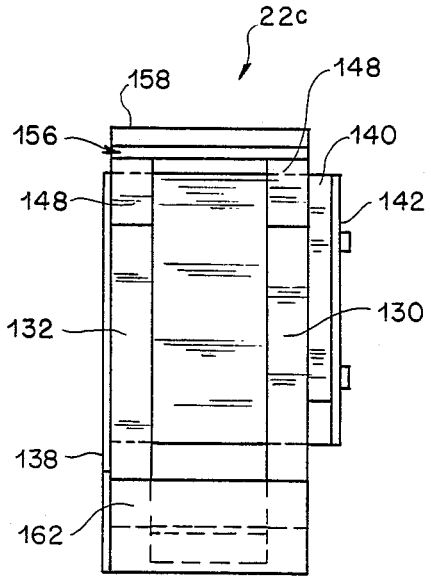
FIG. 22 is a front elevational view of the cassette tape player holder of FIG. 17.

Each leg 130–136 includes a reduced diameter section 144, as shown best in FIG. 19, which defines a spring retaining surface 146. In this regard, an arm 148 is slidably received within each leg 130–136 and includes a rod 150 connected to one end thereof which extends through reduced diameter section 144 and terminates in an enlarged head 152 having a dimension greater than that of reduced dimension section 144. In addition, a coil spring 154 is positioned between spring retaining surface 146 and enlarged head 152. Therefore, when arm 148 is pulled out of a respective leg 130–136, coil spring 154 is compressed between enlarged head 152 and spring retaining surface 146. As a result, when the pulling force on 148 is released, coil spring 154 expands so as to pull arm 148 back into the respective leg 130–136. In effect, the arrangement described with respect to FIG. 19 is similar to the spring biased lever found in conventional pin-ball machines which are used to eject the balls into play.

The opposite ends of arms 148 extending from vertical legs 130 and 132 are connected by an L-shaped gripping member 156 to prevent total retraction of arm 148 within legs 130 and 132. In addition, the inwardly directed flange 158 of gripping member 156 forms a gripping surface for gripping a cassette tape player 12, as will be described in greater detail hereinafter. In like manner, an L-shaped gripping member 160 connects the free ends of arms 148 extending from horizontal legs 134 and 136 and includes an inwardly directed flange 162 for gripping the cassette tape player 12 positioned therein in the horizontal direction.

In operation, the user grasps flanges 158 and 162 and pulls them outwardly, against the forces of the respective springs 154 in each leg. A cassette tape player 12 is then positioned against legs 130–136, whereupon flanges 158 and 162 are released. As a result, springs 154 cause flanges 158 and 162 to be pulled inwardly and to thereby grip the exposed edges of cassette tape player 12 and hold the same safely.

As with the aforementioned cassette tape player holders 22a and 22b, three female snap elements 164, are provided on the outer surface of support section 142 of securing plate 140 and are adapted to mate with male snap elements 32 on belt 20 to removably secure cassette tape player 22 at the left or right hip of the user.

Figure 29:
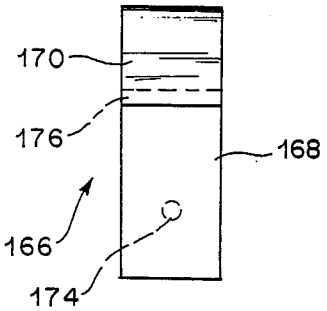
FIG. 29 is a front plan view of a clip for holding the cassette tape holders of FIGS. 25 and 27 on an existing belt about the waist of a person.
Figure 30:
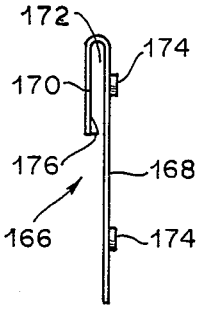
FIG. 30 is a side elevational view of the clip of FIG. 29.
Figure 31:
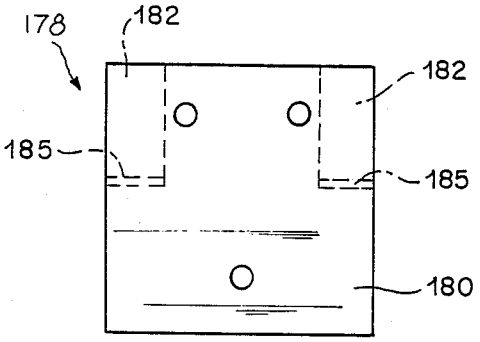
FIG. 31 is a front plan view of a clip for securing any of the cassette tape player holders of FIGS. 2–22 on an existing belt about the waist of a person.
Figure 32:
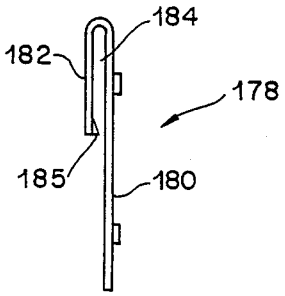
FIG. 32 is a side elevational view of the clip of FIG. 31.

It will be appreciated that various modifications can be made to the present invention within the scope of the claims herein. For example, a clip 166, as shown in FIGS. 29 and 30 can be used to secure a cassette tape holder 24 or 26 onto an existing belt that does not have male snap elements 30. In this regard, clip 16 includes a flat, rectangular plate 168 having its upper end 170 bent over so as to be substantially parallel to plate 168 and to define a space 172 therebetween. Thus, upper end 170 can be placed over and behind an existing belt so that such existing belt is positioned within space 172. In this regard, rectangular plate 168 is provided with two male snap elements 174 spaced apart and vertically aligned so as to receive female snap elements 44, 46 or 44', 46' and to thereby secure the respective cassette tape holder 24 or 26 thereto. In addition, a small projection 176 can be provided at the free end of the upper, bent over end 170 so as to securely retain clip 166 on an existing belt.

In like manner, a clip 178 can be provided for securing a cassette tape player holder 22 on an existing belt which does not have male snap elements 32. In this regard, clip 178 includes a substantially square plate 180, having bent over tab sections 182 at the upper end thereof and at opposite sides thereof so as to define spaces 184 between plate 180 and tab sections 182. Thus, tab sections 182 can be placed over and behind an existing belt so that such existing belt is positioned within space 184. In addition, three male snap elements 186 are provided on the opposite side of plate 180 in a triangular configuration so as to receive the female snap elements 114, 126 or 164 of cassette tape player holders **22*a*, 22*b* or 22*c*, respectively, to thereby secure the respective cassette tape player holder 22*a*, 22*b* or 22*c* onto an existing belt. In addition, small projections 185 can be provided at the free end of each tab section 182 so as to securely retain clip 178** on an existing belt.

Figure 33:
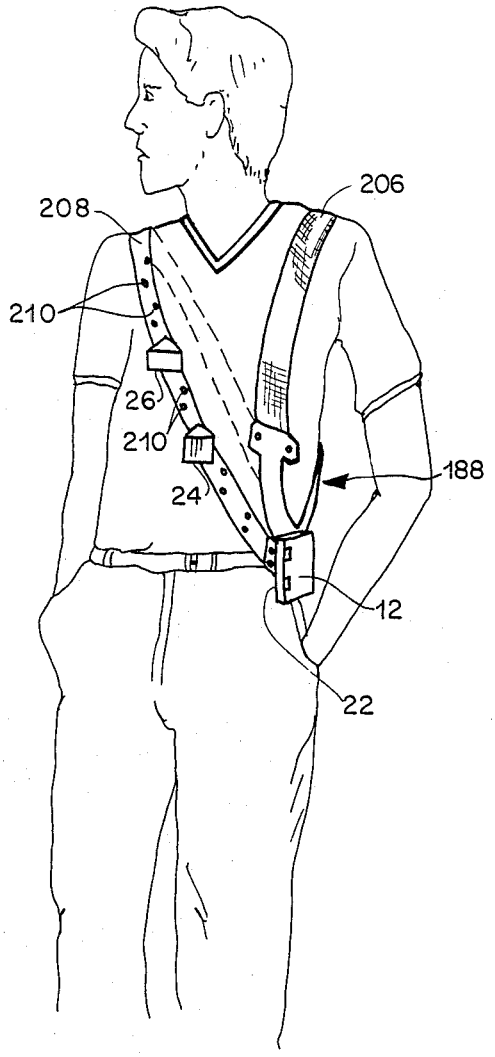
FIG. 33 is a perspective view of apparatus for carrying a cassette tape player and a plurality of cassette tapes on the body of a person according to another embodiment of the present invention, in which a holster-type belt is worn by the person.
Figure 34:
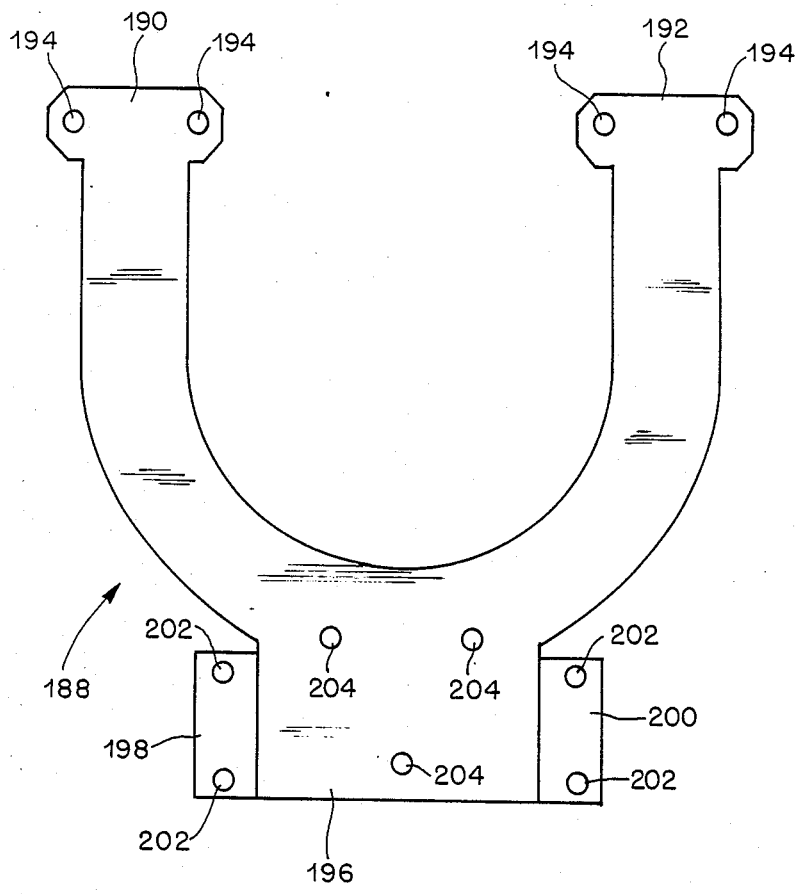
FIG. 34 is a plan view of the holster portion of the belt of FIG. 33.

As another example of a modification according to the present invention, reference is made to FIGS. 33 and 34 which shows a different belt arrangement. Specifically, a U-shaped holster-type support member 188 includes two upper free ends 190 and 192, each having two male snap elements 194 thereon. A downwardly extending support extension 196 is formed at the lower, central portion of holster-type support member 188 and has two connecting tabs 198 and 200 connected at opposite sides thereof, each connecting tab including two female snap elements 202. In addition, support extension 196 includes three male snap elements 204 formed in a triangular configuration and having dimensions so as to receive female snap elements 114, 126 or 164 of cassette tape player holders **22*a*, 22*b* and 22*c* to thereby secure the same thereon. A first shoulder strap 206 has female snap elements (not shown) at opposite ends thereof which are connected to male snap elements 194 of free ends 190 and 192 of support member 198, with first shoulder strap 206 extending over the near shoulder when U-shaped support member 188 is positioned under an arm and just above the hip of a person. A second shoulder strap 208 has opposite free ends with male snap elements 210, as shown, which are secured to female snap elements 202 of tabs 198 and 200, with second shoulder strap 208 extending over the far shoulder of the person, as shown in FIG. 33. Thus, since a plurality of pairs of male snap elements 210 are provided, the length of second shoulder strap 208 can be adjusted for the individual user. In addition, male snap elements 210 which are provided along second shoulder strap 208 and extend across the chest of the person, are situated at an angle on second shoulder strap 208 so that when second shoulder strap 208 is strapped across the chest of the person, pairs of vertically aligned male snap elements 210 aire provided, as shown. In this regard, a plurality of cassette tape holders 24 and 26** can be secured thereon.

It will thus be appreciated that the present invention provides a versatile arrangement in which a plurality of cassette tapes and a cassette tape player can be readily and easily carried on the body of a person. In this regard, the number and positions of cassette tape holders for carrying the cassette tapes can be easily varied. Also, the cassette tape player holder can be positioned on either side of the body of the user for comfort. The present invention also provides distinct cassette tape player holders that can be used with the present invention.

It will also be appreciated that the present invention can be made relatively inexpensively. For example, each belt 20, and shoulder straps 206 and 208 can be made from polyethylene or an elastic material. All of the cassette tape player holders 22 and cassette tape holders can be made from a plastic material, and all components can be covered with any suitable material, such as canvas, rubber, leather, suede or the like and can contain any desired patterns thereon.

Having described specific preferred embodiments of the present invention, it will be appreciated that the present invention is not limited to those precise embodiments, and that various changes and modifications can be effected therein by one of ordinary skill in the art without departing from the spirit or scope of the invention as defined by the appended claims.

What is claimed is:

1. Apparatus for carrying a cassette tape player and a plurality of cassette tapes on the body of a person, comprising:

belt means for securement about the body of the person;

tape player holder means for holding a cassette tape player;

first securing means for releasably securing said tape player holder means on said belt means, said first securing means including a plurality of first securing elements mounted on said belt means and at least least one second securing element mounted to said tape holder means for engaging with at least one of said first securing elements so as to releasably secure said tape player holder means on said belt means, each said first securing element being one of a male snap element and a female snap element and each said second securing element being the other of a male snap element and a female snap element, the snap elements mounted on said belt means being arranged in a substantially triangular configuration on said belt means and said snap elements mounted to said tape player holder means being arranged in an identical substantially triangular configuration on said tape player holder means;

a plurality of cassette tape holder means for holding the plurality of cassette tapes; and second securing means for releasably securing each said cassette tape holder means at a selected one of a plurality of different positions on said belt means, said securing means including a plurality of first securing elements mounted on said belt means and at least one second securing element mounted on each cassette tape holder means for engaging with at least one of said first securing elements to releasably secure each cassette tape holder means at a selected one of a plurality of different positions on the belt means.

2. Apparatus for carrying a cassette tape player and a plurality of cassette tapes on the body of a person, comprising:

belt means for securement about the body of the person;

tape player holder means for holding a cassette tape player, said tape player holder means including:

bottom leg means for supporting the cassette tape player;

rear leg means secured to said bottom leg means for restraining the cassette tape player;

restraining leg means telescopically movable with respect to at least one of said bottom leg means and said rear leg means;

said restraining leg means including a free end having gripping means for gripping the cassette tape player;

biasing means connected between said restraining leg means and said at least one of said bottom leg means and said rear leg means for biasing said restraining leg means toward said at least one of said bottom leg means and rear leg means so that the gripping means of said restraining leg means grips the cassette tape player; and first securing means for releasably securing said tape player holder means on said belt means, said securing means including means for releasably securing at least one of said bottom leg means and said rear leg means on said belt means;

a plurality of cassette tape holder means for holding a plurality of cassette tapes; and second securing means for releasably securing each said cassette tape holder means at a selected one of a plurality of different positions on said belt means.

3. Apparatus for carrying a cassette tape player and at least one cassette tape on the body of a person, comprising:

(a) belt means for securement about the body of the person;

(b) tape player holder means for holding a cassette tape player, said tape player holder means including:

(i) bottom leg means for supporting the cassette tape player;

(ii) rear leg means secured to said bottom leg means for restraining the cassette tape player;

(iii) restraining leg means telescopically movable with respect to at least one of said bottom leg means and said rear leg means, said restraining leg means including (A) a first restraining arm telescopically movable in said bottom leg means and (B) a second restraining arm telescopically movable in said rear leg means;

(C) each restraining arm including a free end having said gripping means connected thereto for gripping the cassette tape player;

(iv) biasing means for biasing said restraining leg means toward said at least one of said bottom leg means and rear leg means so that the gripping means of said restraining leg means grips the cassette tape player;

(c) first securing means for releasably securing said tape player holder means on said belt means, said first securing means including means for releasably securing at least one of said bottom leg means and said rear leg means on said belt means;

(d) at least one cassette tape holder means for holding at least one cassette tape; and (e) second securing means for releasably securing each said cassette tape holder means at a selected one of a plurality of different positions on said belt means.

4. Apparatus according to claim 3; wherein said biasing means includes spring means for biasing each arm into a respective restraining leg means so that the gripping means of said restraining arms grips the cassette tape player.

5. A holder for a cassette tape player, comprising:

bottom leg means for supporting the cassette tape player;

rear leg means secured to said bottom leg means for restraining the cassette tape player;

restraining leg means telescopically movable with respect to at least one of said bottom leg means and said rear leg means;

said restraining leg means including a free end having gripping means for gripping the cassette tape player;

biasing means connected between said restraining leg means and said at least one of said bottom leg means and said rear leg means for biasing said restraining leg means toward said at least one of said bottom leg means and rear leg means so that the gripping means of said restraining leg means grips the cassette tape player; and securing means for releasably securing at least one of said bottom leg means and said rear leg means onto wearing apparel secured on the body of a person.

6. A holder for a cassette tape player, comprising:

(i) bottom leg means for supporting the cassette tape player;

(ii) rear leg means secured to said bottom leg means for holding the cassette tape player;

(iii) restraining leg means telescopically movable with respect to at least one of said bottom leg means and said rear leg means, said restraining leg means including:

(A) a first restraining arm telescopically movable in said bottom leg means; and (B) a second restraining arm telescopically movable in said rear leg means;

(C) each restraining arm including a free end having said gripping means connected thereto for gripping the cassette tape player;

(iv) biasing means for biasing said restraining leg means toward said at least one of said bottom leg means and rear leg means so that the gripping means of said restraining leg means grips the cassette tape player; and (v) securing means for releasably securing at least one of said bottom leg means and said rear leg means onto wearing apparel secured on the body of a person.

7. A holder according to claim 6; wherein said biasing means includes spring means for biasing each arm into a respective restraining leg means so that the gripping means of said restraining arms grips the cassette tape player.

* * * * *